US006139285A

United States Patent [19]

Uchida et al.

[11] Patent Number: 6,139,285

[45] Date of Patent: Oct. 31, 2000

[54] HYDRAULIC PUMP FOR POWER STEERING SYSTEM

[75] Inventors: Yukio Uchida; Tetsuya Ishii; Atsushi Ishizuka; Masateru Yamamuro, all of Kanagawa, Japan

[73] Assignee: Unisia Jecs Corporation, Atsugi, Japan

[21] Appl. No.: 09/092,859

[22] Filed: Jun. 8, 1998

[30] Foreign Application Priority Data

Jun. 25, 1997 [JP] Japan ..... 9-184410

[51] Int. Cl.[7] ..... F04B 49/00

[52] U.S. Cl. ..... 417/300; 417/308; 417/310

[58] Field of Search ..... 417/300, 308, 417/310, 297, 440, 441

[56] References Cited

U.S. PATENT DOCUMENTS

| | | | |
|---|---|---|---|
| 3,266,426 | 8/1966 | Brunson | 417/310 X |
| 3,446,230 | 5/1969 | Swedberg | 417/300 X |
| 4,597,718 | 7/1986 | Nakano et al. | 417/300 |
| 4,714,413 | 12/1987 | Duffy | 417/300 X |
| 5,032,061 | 7/1991 | Porel | 417/297 X |
| 5,098,259 | 3/1992 | Ohtaki et al. | 417/308 |
| 5,226,802 | 7/1993 | Nakamura et al. | 417/310 X |
| 5,236,315 | 8/1993 | Hamao et al. | 417/295 |
| 5,513,960 | 5/1996 | Uemoto | 417/300 |
| 5,803,716 | 9/1998 | Wallis et al. | 417/310 |
| 5,810,565 | 9/1998 | Eppli | 417/300 |
| 5,860,797 | 1/1999 | Fujimura et al. | 417/440 |

FOREIGN PATENT DOCUMENTS 5-96477 12/1993 Japan .

*Primary Examiner*—Timothy S. Thorpe
*Assistant Examiner*—David J. Torrente
*Attorney, Agent, or Firm*—Foley & Lardner

[57] ABSTRACT

A hydraulic pump including a pressure chamber, a drain passage communicable with the pressure chamber, a delivery port, a discharge path fluidly connecting the pressure chamber with the delivery port, and an orifice disposed in the discharge path. A first flow control valve is provided for variably controlling fluid communication between the pressure chamber and the drain passage in response to a difference between fluid pressures upstream and downstream of the orifice. A second flow control valve is disposed within the discharge path, which is operative to variably control an opening area of the orifice in response to energy of fluid passing through the discharge path. The second flow control valve includes a moveable spool exposed to a fluid pressure within the pressure chamber, a spring biasing the spool in such one direction as to increase the opening area of the orifice, and a spring retainer cooperating with the spool to define a spring chamber accommodating the spring.

17 Claims, 6 Drawing Sheets

HYDRAULIC PUMP FOR POWER STEERING SYSTEM

BACKGROUND OF THE INVENTION

1. Field of the Invention

The present invention relates to a hydraulic pump for a power steering system in motor vehicles.

In power steering systems for assisting torque generated in manual steering by using a hydraulic fluid as medium, a hydraulic pump installed in the motor vehicles is utilized as power source for supplying the hydraulic fluid to the power steering systems. It is desirable that the power steering systems provide sufficient steering assistance at low vehicle speed or stop, that is, at low rotational speed of an internal combustion engine. Meanwhile, since resistance generated by contact of tires with a road surface is less at high vehicle speed, i.e., at high rotational speed of the engine, than that at low vehicle speed whereby the steering at the high vehicle speed is relatively stable, the power steering systems are not required to provide so great steering assistance at the high vehicle speed. Accordingly, the hydraulic pump increasing its power output as the rotational speed of the engine increases, is unsuitable per se as power source to the power steering systems.

There have been proposed hydraulic pumps with a flow control valve which permits a predetermined amount of hydraulic fluid to be supplied to actuators of the power steering systems for good power steering operation at the idling or low rotational speed of the engine and reduces the predetermined amount of the fluid to an appropriate value for the power steering operation at the high rotational speed of the engine.

2. Description of the Related Art

A hydraulic pump of such a kind is disclosed in Japanese Patent (Utility Model) Application First Publication No. 5-96477. This pump includes a pressure chamber, a drain passage communicable with the pressure chamber, a discharge passage for delivering hydraulic fluid within the pressure chamber to an actuator of a power steering system, a control orifice disposed within the discharge passage, and a first flow control valve for controlling fluid communication between the drain passage and the pressure chamber in response to a difference between a fluid pressure upstream of the control orifice and a fluid pressure downstream thereof. The control orifice includes a main throttle passage and a subsidiary throttle passage arranged in parallel to each other. A second flow control valve is provided for controlling an opening area of the subsidiary throttle passage in response to a difference between fluid pressures within the discharge passage 8 and slots of a rotor which receive slidable vanes. The second flow control valve includes a spool within a spool bore crossing the subsidiary throttle passage and communicating with the slots and the discharge passage, and a spring biasing the spool so as to increase the opening area of the subsidiary throttle passage.

The conventionally known pump allows the fluid within the pressure chamber to be divided into a controlled fluid flow passing through the main and subsidiary throttle passages of the control orifice and an excess fluid flow fed from the pressure chamber to a reservoir tank via the drain passage opened in response to the difference between the fluid pressures upstream and downstream of the control orifice. The controlled fluid flow through the main and subsidiary throttle passages is fed to the actuator to provide the steering assistance required at the low rotational speed of the engine. On the other hand, if the rotational speed of the engine exceeds a predetermined value, then the fluid communication of the drain passage with the pressure chamber increases and the controlled fluid flow is limited to a main fluid flow passing through the main throttle passage by restraining an auxiliary fluid flow through the subsidiary throttle passage. Thus, the fluid flow delivered to the actuator is reduced.

In the conventionally known pump, the spring biasing the spool of the second flow control valve is exposed to the fluid flow passing through the subsidiary throttle passage. It is likely that the fluid flow strikes the spring and causes a so-called Karman vortex to vibrate the spring. This may disturb smooth movement of the spool within the spool bore, resulting in unstable flow control characteristic of the second flow control valve.

It is an object of the present invention to provide a hydraulic pump for power steering systems which is capable of supplying hydraulic fluid having a stable flow characteristic.

SUMMARY OF THE INVENTION

According to one aspect of the present invention, there is provided a hydraulic pump, comprising:

a housing;

a pressure chamber within the housing;

a drain passage communicable with the pressure chamber;

a delivery port;

a discharge path fluidly connecting the pressure chamber with the delivery port;

an orifice disposed in the discharge path;

a first flow control valve operative to variably control fluid communication between the pressure chamber and the drain passage in response to a difference between a fluid pressure upstream of the orifice and a fluid pressure downstream of the orifice; and a second flow control valve disposed within the discharge path and operative to variably control an opening area of the orifice in response to energy of fluid passing through the discharge path, the second flow control valve comprising a moveable spool having a bearing surface to which a fluid pressure within the pressure chamber is applied, a spring biasing the spool in such one direction as to increase the opening area of the orifice, and a moveable spring retainer supporting the spring and cooperating with the spool to define a spring chamber accommodating the spring.

DESCRIPTION OF THE PREFERRED EMBODIMENT

Referring now to FIGS. 1 to 8, a preferred embodiment of a hydraulic pump according to the present invention is now explained.

Figure 1:
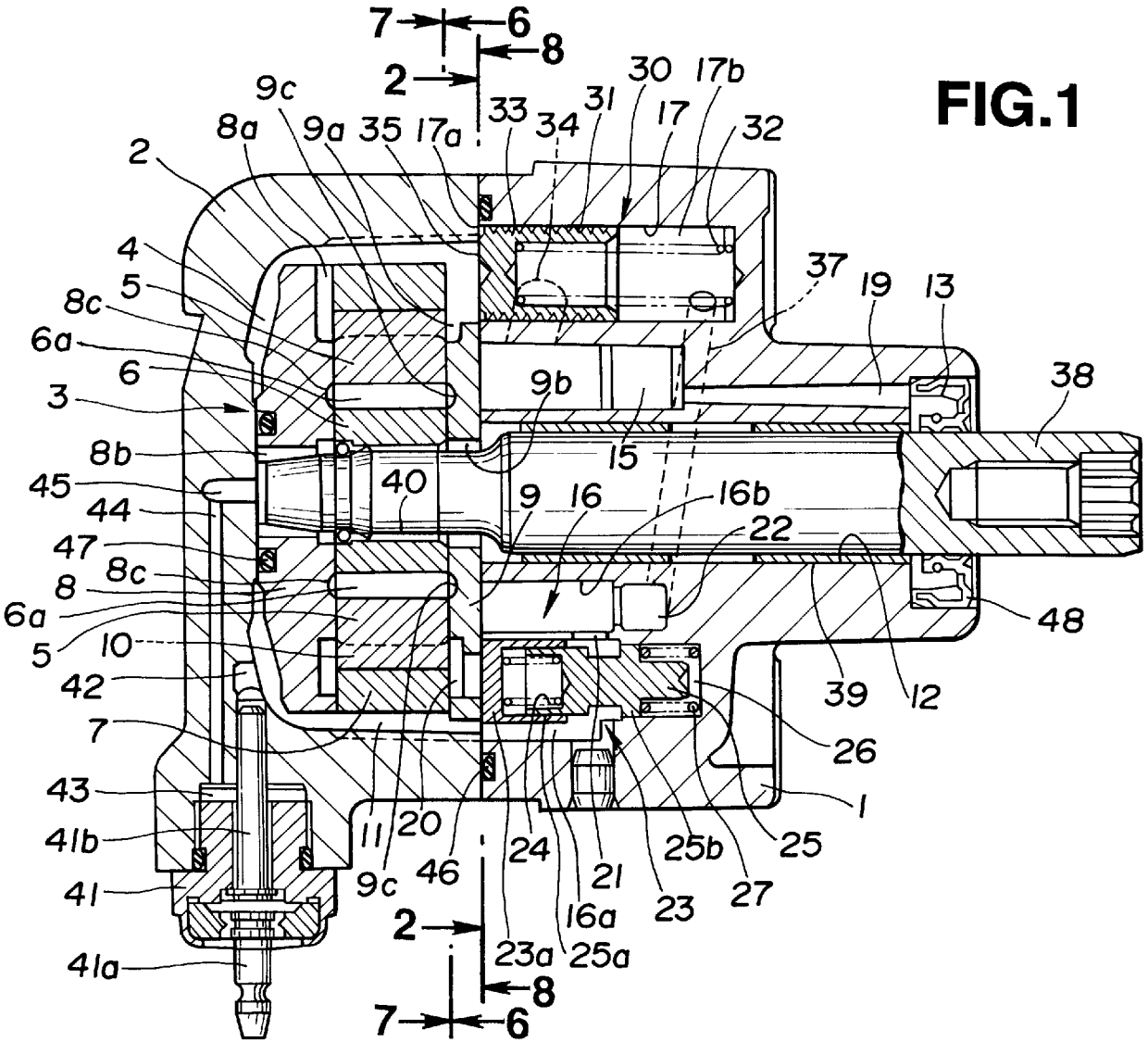
FIG. 1 is a longitudinal section, taken along an axis of a drive shaft, of a hydraulic pump according to the present invention.

As illustrated in FIG. 1, the hydraulic pump includes a housing 1, a cover 2 cooperating with the housing 1 to define a cavity 4, and a pump unit 3 disposed within the cavity 4. The housing 1 is made of a suitable metal such as aluminum alloy. The cover 2 is also made of a suitable metal.

Figure 6:
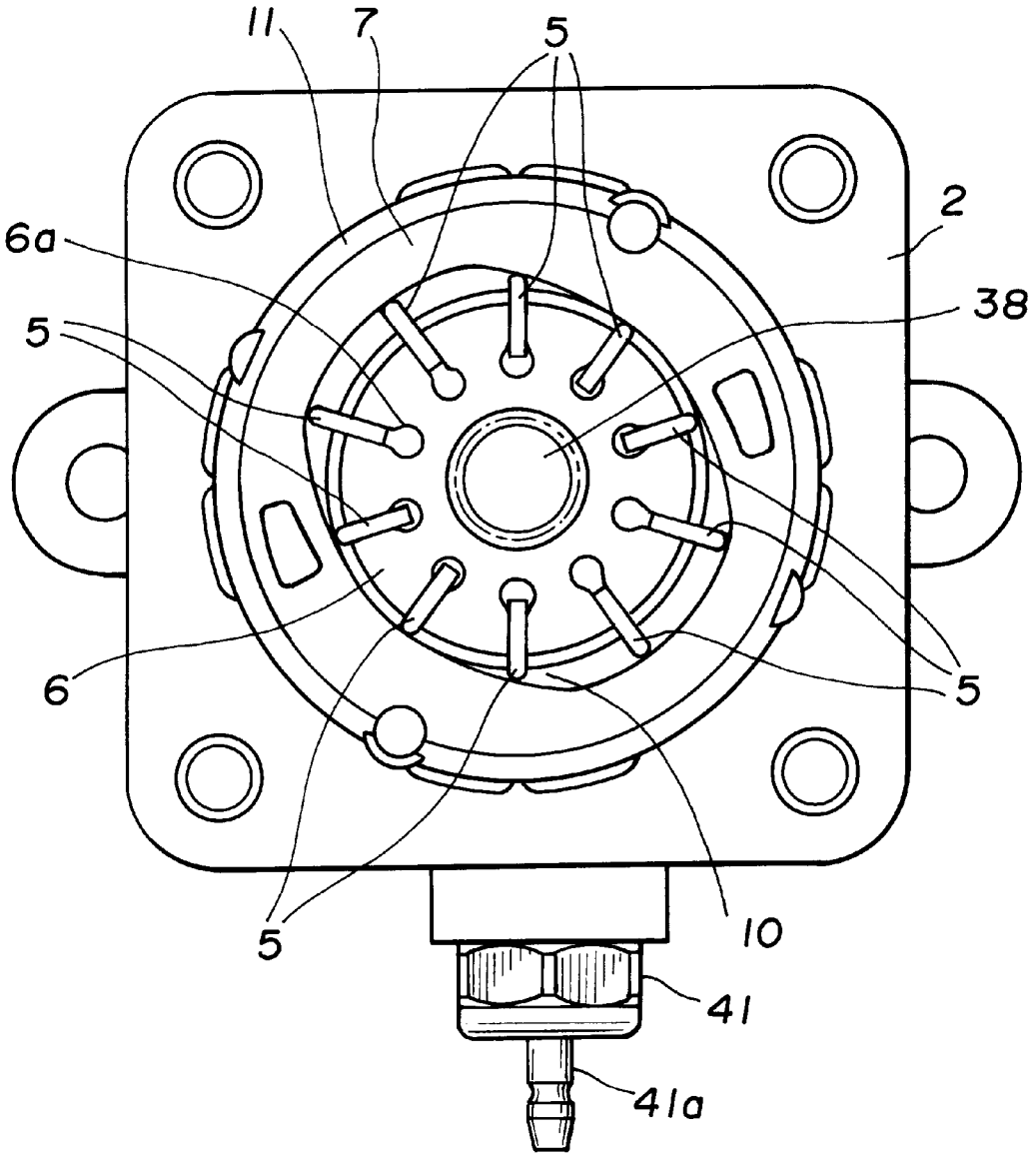
FIG. 6 is a section taken along the line 6—6 of FIG. 1, showing a pump unit within a cover.
Figure 7:
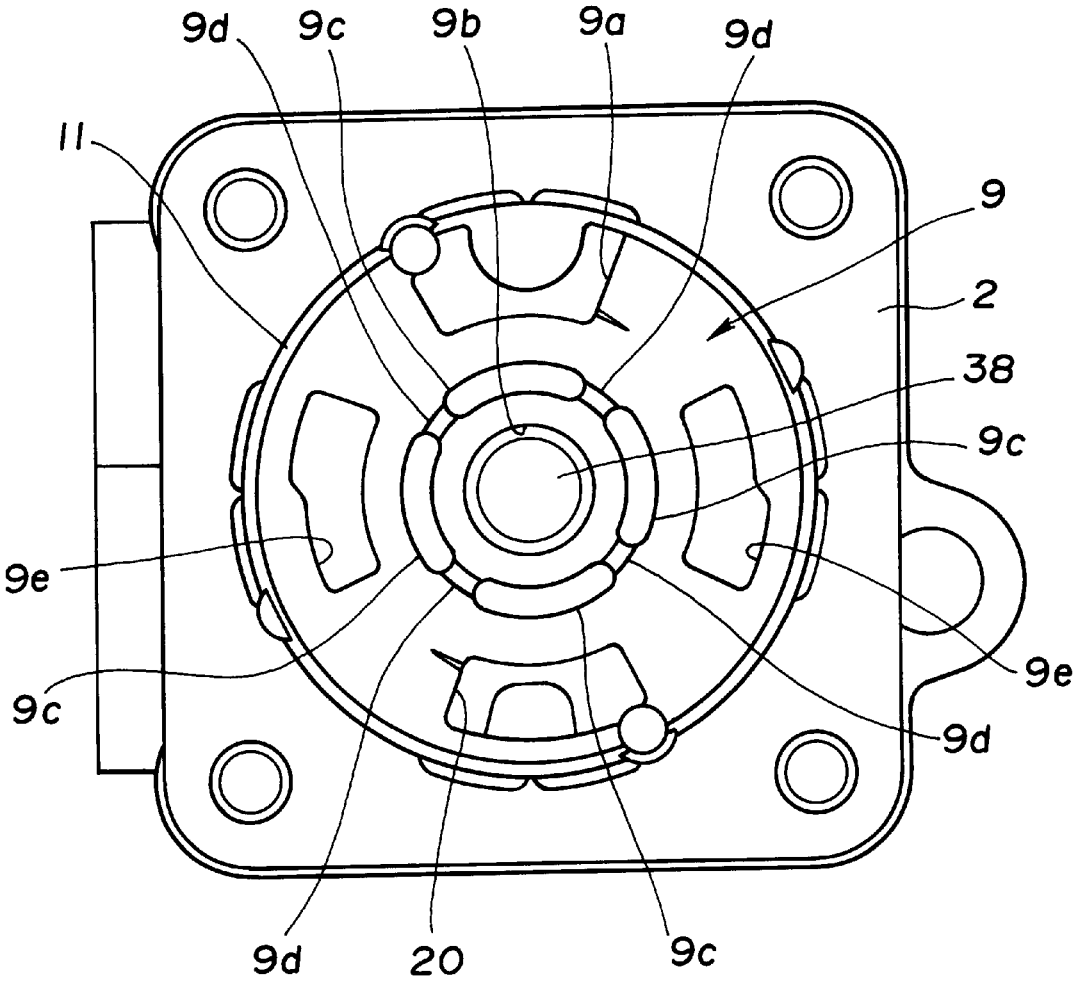
FIG. 7 is a section taken along the line 7—7 of FIG. 1, showing one end face of an end plate.

As illustrated in FIGS. 1 and 6, the pump unit 3 is of a rotary-vane type and includes a cam ring 7, a cylindrical rotor 6 disposed inside the cam ring 7, and two end plates 8 and 9 secured to the cam ring 7. The rotor 6 is fixedly connected with a drive shaft 38 by intermeshing engagement 40 such as serrations and rotatably driven by the drive shaft 38. A plurality of vanes 5 are mounted to the rotor 6. The cam ring 7 has an internal circumferential cam surface on which the vanes 5 are slidable in direct contact relation. The cam ring 7 has intake ramps and discharge ramps which form the internal circumferential cam surface and are alternately arranged. The vanes 5 slide on the intake ramps upon an intake mode of operation, while the vanes 5 slide on the discharge ramps upon a discharge mode of operation. The vanes 5 are guided radially reciprocally in vane slots 6*a* which radially extend and are arranged in circumferentially spaced relation to each other in the rotor 6 as best shown in FIG. 6. The vane slots 6*a* are fluidly connected with fluid pressure induction paths for inducing fluid pressure causing the reciprocating motion of the vanes 5 in the vane slots 6*a*, which include induction grooves 8*c* and 9*c* shown in FIG. 1. The induction grooves 8*c* and 9*c* are respectively formed in one end face of each of the end plates 8 and 9 which mates with the pump unit 3. As shown in FIG. 7, four induction grooves 9*c* are formed into an arcuate shape and circumferentially spaced apart from each other in the end plate 9 and the adjacent two thereof are communicated with each other via a throttle groove 9*d*. Two sets of the opposed two of the induction grooves 9*c* are disposed corresponding to the intake and discharge ramps of the cam ring 7. One of the two sets corresponding to the intake ramps are adapted to induce fluid discharged from the pressure chamber 11 into the vane slots 6*a* which are connected with the induction grooves 9*c* upon rotation of the rotor 6, such that each of the vanes 5 is forced to move radially outward from the vane slot 6*a* as the vane 5 moves along the intake ramps. The other set corresponding to the discharge ramps allow fluid in the vane slots 6*a* which are connected with the induction grooves 9*c* upon rotation of the rotor 6, to be induced to the adjacent induction groove 9*c* via the throttle groove 9*d* such that each of the vanes 5 is permitted to move radially inward as the vane 5 moves along the discharge ramps.

The vanes 5, an outer peripheral surface of the rotor 6, the internal circumferential cam surface of the cam ring 7 and the end plates 8 and 9 cooperate to define pumping chambers 10. The pumping chambers 10 vary in volume as the rotor 6 with the vanes 5 rotates. Under the discharge mode of operation, the adjacent vanes 5 on the rotor 6 move along the discharge ramps to cause volumetric decrease of the pumping chamber 10 therebetween. The pumping chamber 10 having the reducing volume communicates with a generally annular pressure chamber 11 defined by the cover 2 and an outer periphery of the pump unit 3 via radially outward extending passages 8*a* and 9*a* which are respectively formed in the end plates 8 and 9 as shown in FIG. 1. With provision of the passages 8*a* and 9*a*, fluid discharged from the volumetrically reducing pumping chamber 10 is introduced into the pressure chamber 11. The pressure chamber 11 communicates with a discharge path 16 which is formed in the housing 1 so as to fluidly connect the volumetric reducing pumping chamber 10 with an actuator of a power steering system, not shown.

Figure 8:
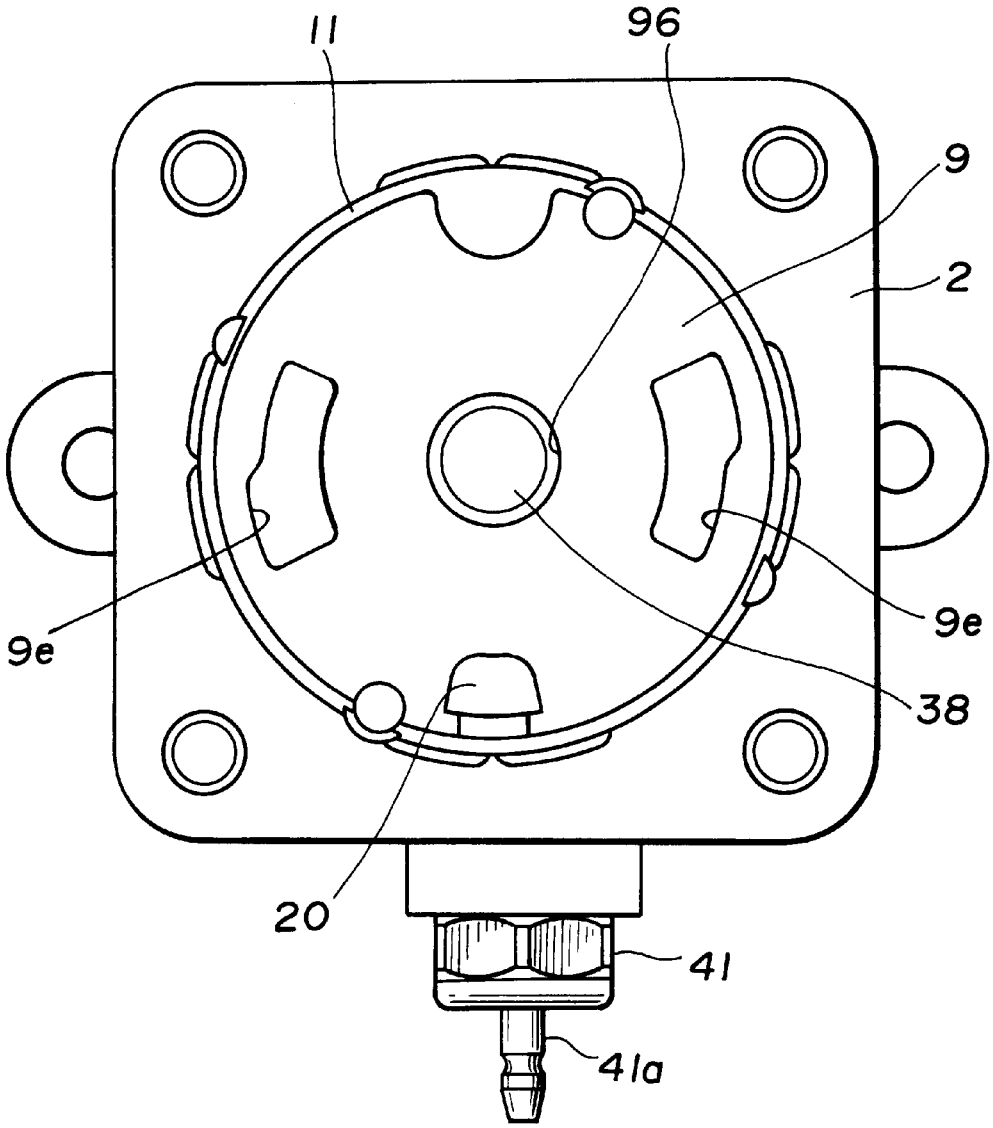
FIG. 8 is a section taken along the line 8—8 of FIG. 1, showing an opposite end face of the end plate.

On the other hand, under the intake mode of operation, the adjacent vanes 5 on the rotor 6 move along the intake ramps to cause volumetric increase of the pumping chamber 10 therebetween. The volumetrically increasing pumping chamber 10 having the increasing volume communicates with a suction path 15 formed in the housing 1 as shown in FIG. 1 via inlet ports 9*e* which are formed in the end plate 9 as shown in FIGS. 7 and 8.

The housing 1 has an axial bore 12 in which the drive shaft 38 is received. The drive shaft 38 includes a body portion rotatably supported by a bushing 29 within the bore 12 of the housing 1, a reduced-diameter portion smaller in diameter than the body portion and engaged with the rotor 6 of the pump unit 3, and a tapered end portion extending from the rotor 6 into a bore 8*b* of the end plate 8 of the pump unit 3. The reduced-diameter portion extends through a bore 9*b* of the end plate 9 coaxial with the bore 8*b* of the end plate 8 and the axial bore 12 of the housing 1. The tapered end portion is fitted to the bore 8*b* of the end plate 8 with play, The axial bore 12 communicates with a seal chamber 13 disposed at one end of the housing 1, via a groove 14 shown in FIG. 2. Fluid leaking out of the pump unit 3 into the axial bore 12 is fed to the seal chamber 13 via the groove 14. A seal ring 48 is disposed within the seal chamber 13.

Figure 2:
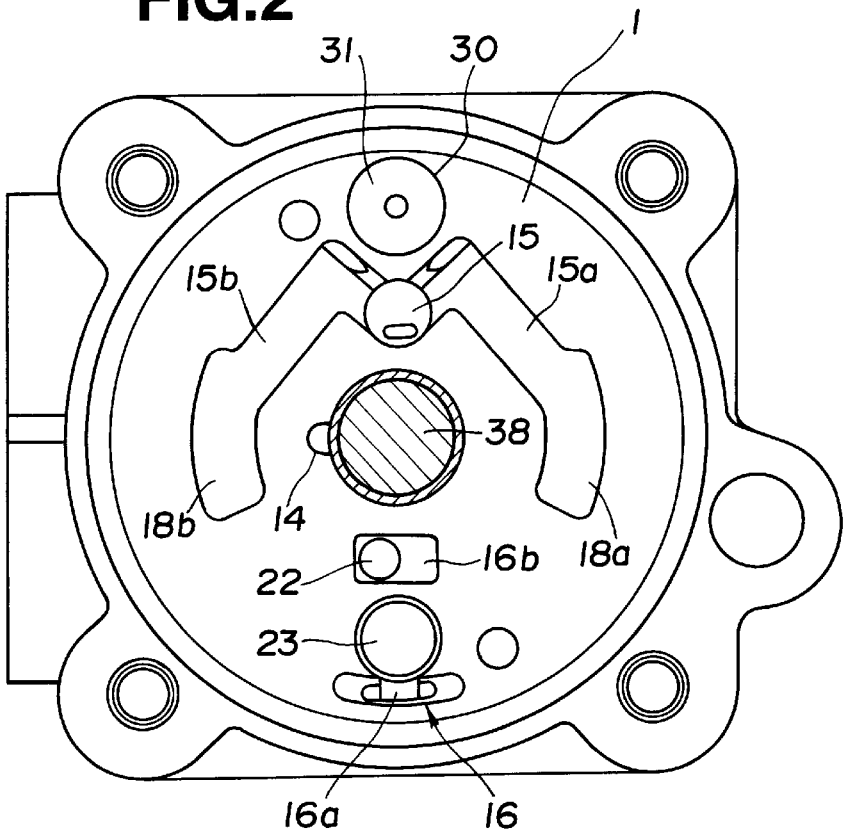
FIG. 2 is a section taken along the line 2—2 of FIG. 1.

As illustrated in FIG. 2, the suction path 15 is open to an end face of the housing 1 which mates with an opposite end face of the end plate 9 of the pump unit 3. The suction path 15 includes two branches 15*a* and 15*b* extending in two substantially circumferential directions on the annular end face of the housing 1, and arcuate-shaped suction ports 18*a* and 18*b* respectively connected with the branches 15*a* and 15*b*. The suction ports 18*a* and 18*b* are aligned with the inlet ports 9*e* of the end plate 9 to communicate the suction path 15 with the volumetrically increasing pumping chamber 10 of the pump unit 3. The suction path 15 communicates with the seal chamber 13 via a reduced pressure passage 19 extending substantially parallel to the axial bore 12 in the housing 1, as shown in FIG. 1.

The discharge path 16 is also open to the end face of the housing 1 which mates with the opposite end face of the end plate 9. The discharge path 16 communicates the pressure chamber 11 of the pump unit 3 with a delivery port 22 fluidly connected with the actuator of the power steering system via an orifice 21. The discharge path 16 includes an induction passage 16*a* and a communication passage 16*b* which are arranged in substantially parallel to the axial bore 12. The orifice 21 is disposed between the induction passage 16*a* and the communication passage 16*b* in substantially perpendicular to the axial bore 12. The induction passage 16*a* and the communication passage 16*b* are disposed upstream and downstream of the orifice 21 and communicated with each other via the orifice 21. Specifically, as best shown in FIG. 3, the induction passage 16*a* communicates with the pressure chamber 11 and the volumetrically reducing pumping chamber 10 via an outlet port 20 formed in the end plate 9, while the communication passage 16*b* is fluidly connected with the delivery port 22.

A flow control valve 23 is disposed within the induction passage 16*a* of the discharge path 16, which is operative to variably control an opening area of the orifice 21 in response to energy of fluid passing through the discharge path 16. The flow control valve 23 includes a moveable spool 23*a* having a bearing surface 23*c* to which a fluid pressure within the pressure chamber 11 is applied, and a spring 24 biasing the spool 23*a* in such one direction as to increase the opening area of the orifice 21. The flow control valve 23 also includes a moveable spring retainer 25 which supports the spring 24 and cooperates with the spool 23*a* to define a spring chamber accommodating the spring 24, and a second spring 27 biasing the spring retainer 25 against a biasing force of the spring 24 which acts on the spring retainer 25 in a direction opposite to the one direction.

Figure 3:
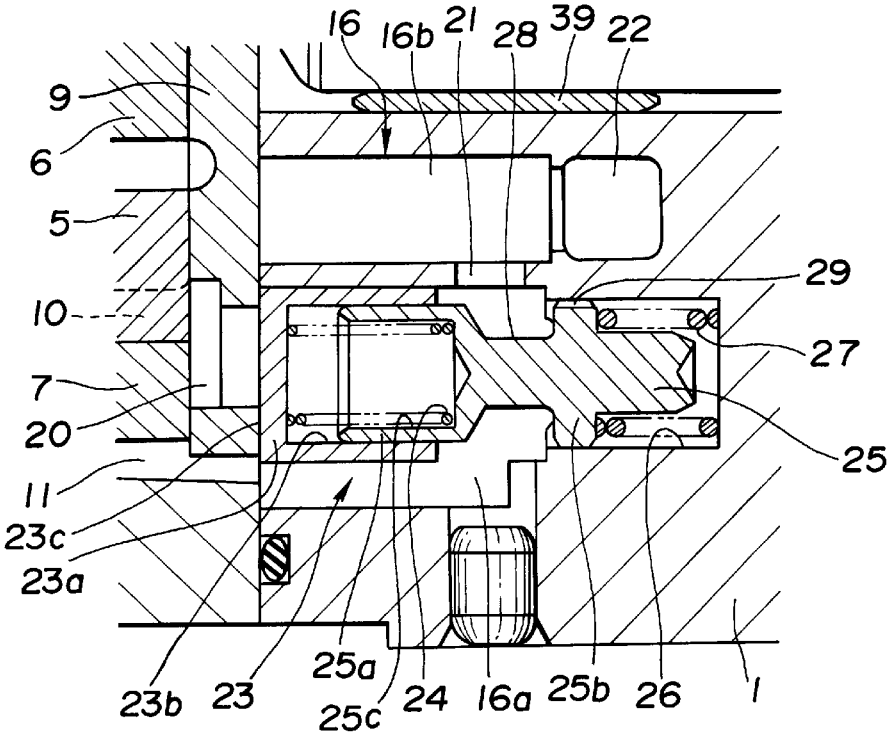
FIG. 3 is a fragmentary enlarged view of an essential part of FIG. 1, showing a flow control valve in an operating position.

Specifically, as best shown in FIG. 3, the spool 23*a* is slidably disposed within the induction passage 16*a* and formed into a hollow cylindrical shape having a closed end. The spool 23*a* includes a cylindrical side wall and a disk-like bottom wall which cooperate together to define a spring mount bore 23*b* forming a part of the spring chamber. The bearing surface 23*c* is located on an outer face of the bottom wall of the spool 23*a* and exposed to the outlet port 20 of the end plate 9. The spring 24 within the spring chamber has one end retained on an inner face of the bottom wall of the spool 23*a*, and an opposite end retained by a spring mount portion 25*a* of the spring retainer 25. The spring 24 has a predetermined biasing force acting on the spool 23*a* to allow a maximum opening area of the orifice 21.

The spring retainer 25 has, at the spring mount portion 25*a*, a spring mount bore 25*c* which is coaxial with the spring mount bore 23*b* of the spool 23*a* to form a part of the spring chamber. The spring mount portion 25*a* retains the opposite end of the spring 24 at a bottom of the spring mount bore 25*c*. The spring mount portion 25*a* is in the form of a hollow cylindrical-shaped flange integrally formed with the spring retainer 25. The flange includes a disk-shaped portion extending radially outward from a shaft-like body portion of the spring retainer 25, and a circumferential portion axially extending from the outer periphery of the disk-shaped portion, which cooperate to define the spring mount bore 25*c*. The spring mount portion 25*a* is fitted into the spring mount bore 23*b* of the spool 23*a* with a predetermined clearance for a smooth sliding movement of the spool 23*a* relative to the spring mount portion 25*a*. The spring mount portion 25*a* has a guide for allowing the sliding movement of the spool 23*a* which is defined by a circumferential outer surface of the cylindrical flange. The spool 23*a* is slidable on the guide of the spring mount portion 25*a* in response to the balance between the energy of fluid flowing from the pressure chamber 11 into the induction passage 16*a* of the discharge path 16 and the biasing force of the spring 24 which acts against the energy of fluid. The opening area of the orifice 21 is variably adjusted by the sliding movement of the spool 23*a*.

The spring retainer 25 has a second spring mount portion 25*b* which is axially spaced from the spring mount portion 25*a* and retains one end of the second spring 27. The spring retainer 25 is formed with a circumferential groove 28 between the first and second spring mount portions 25*a* and 25*b* which is exposed to the orifice 21. The second spring mount portion 25*b* cooperates with the housing 1 to define a second spring chamber accommodating the second spring 27. The second spring chamber is prevented from being exposed to the fluid flow passing through the discharge path 16. Specifically, the second spring mount portion 25*b* is in the form of a collar integrally formed with the spring retainer 25 and extending radially outward from the shaft-like body portion of the spring retainer 25. The housing 1 has a spring mount hole 26 forming a part of the second spring chamber, at a bottom of which an opposite end of the second spring 27 is retained. The second spring mount portion 25*b* is slidably mounted to the spring mount hole 26 of the housing 1. The second spring mount portion 25*b* has one axial end face exposed to the second spring chamber, on which the one end of the second spring 27 is retained. The second spring mount portion 25*b* also has, on its peripheral surface, an axial groove 29 communicating the second spring chamber with the induction passage 16*a* of the discharge path 16.

The second spring 27 biases the spring retainer 25 with the spool 23*a* toward the outlet port 20 of the end plate 9. Namely, the second spring 27 biases the spool 23*a* in such the direction as to increase the opening area of the orifice 21. In this embodiment, the second spring 27 has a biasing force greater than the biasing force of the spring 24 which acts on the spring retainer 25 in the opposite direction. The spring retainer 25 is moveable relative to the housing 1 in response to the balance between the energy of fluid discharged from the pressure chamber 11 into the discharge path 16 and the biasing force of the second spring 27 acting against the fluid energy.

Figure 4:
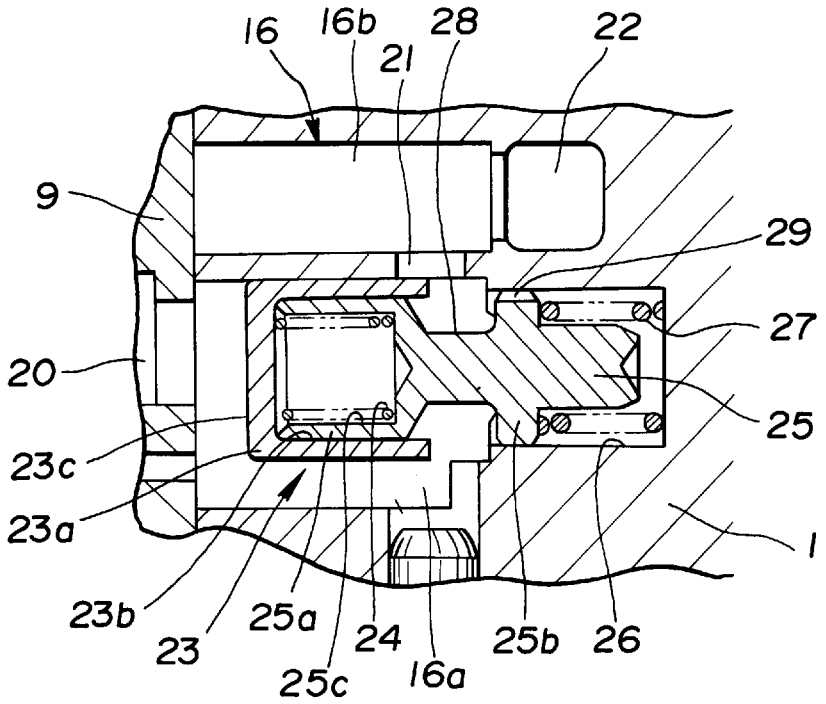
FIGS. 4 and 5 are views similar to FIG. 3, but showing the flow control valve in different operating positions from the position of FIG. 3.
Figure 5:
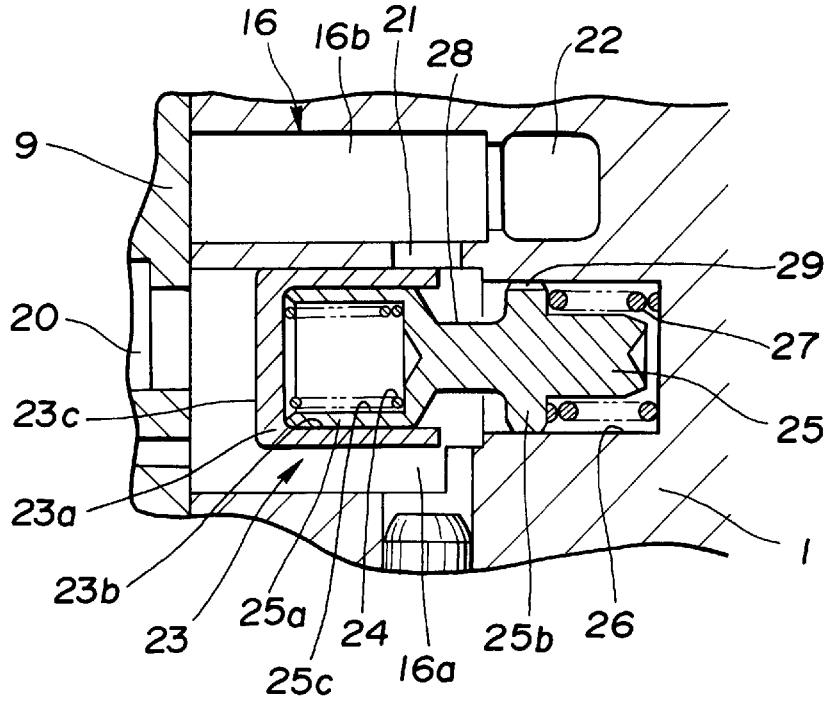

With the arrangement described above, the spool 23*a* is moveable relative to the orifice 21 in response to the balance between the energy of fluid discharged from the pressure chamber 11 into the discharge path 16 and the respective biasing forces of the springs 24 and 27 acting against the fluid energy. The spool 23*a* has a first position, a second position and a third position as shown in FIGS. 3 to 5. In the first position, the spool 23*a* allows a maximum opening area of the orifice 21 to permit a large amount of the fluid flowing through the discharge path 16 into the delivery port 22. Specifically, the fluid in the pressure chamber 11 flows into the delivery port 22 via the outlet port 20, the induction passage 16*a*, the circumferential groove 28 of the spring retainer 25, the orifice 21 and the communication passage 16*b*. The spool 23*a* is urged by the predetermined biasing force of the spring 24 to be contacted at the outer periphery of the bottom wall with the end face of the end plate 9. The biasing force of the spring 24 acting on the spool 23*a* overcomes the fluid pressure within the pressure chamber 11, namely, the fluid pressure within the volumetrically reducing pumping chamber 10 which is exerted on the bearing surface 23*c* of the spool 23*a* via the outlet port 20. In the second position, the spool 23*a* is forced by the fluid discharged from the pumping chamber 10 via the outlet port 20 to slide on the spring retainer 25 against the predetermined biasing force of the spring 24 so that the opening area of the orifice 21 is limited to a medium smaller than the maximum. The amount of the fluid flowing through the discharge path 16 into the delivery port 22 is reduced at the limited opening area of the orifice 21. The fluid pressure within the pressure chamber 11 exceeds the biasing force of the spring 24 acting on the spool 23*a* so that the bottom wall of the spool 23*a* is urged against a distal end of the first spring mount portion 25*a* of the spring retainer 25. The fluid communication between the outlet port 20 and the induction passage 16*a* of the discharge path 16 is permitted. In the third position, the spool 23*a* is forced together with the spring retainer 25 by the fluid pressure within the pressure chamber 11 to move against the biasing force of the second spring 27 to limit the opening area of the orifice 21 to a minimum smaller than the medium. The amount of the fluid flowing into the delivery port 22 via the orifice 21 further decreases. In this state, the fluid pressure within the pressure chamber 11 exceeds the biasing force of the second spring 27 to urge the spring retainer 25 with the spool 23*a* toward the bottom of the spring mount hole 26. Thus, the spool 23*a* is moveable from the first position to the second position against the predetermined biasing force of the spring 24 and from the second position to the third position against the biasing force of the second spring 27.

Referring back to FIG. 1, a flow control valve 30 is disposed within the housing 1. The flow control valve 30 is operative to variably control fluid communication between the pressure chamber 11 and a drain passage 34 communicating with the suction path 15, in response to a difference between a fluid pressure upstream of the orifice 21 and a fluid pressure downstream of the orifice 21. The flow control valve 30 includes a spool 31 slidably disposed within a spool bore 17 extending substantially parallel to the axial bore 12 of the housing 1, and a spring 32 biasing the spool 31 toward the end plate 9 of the pump unit 3. The spool 31 divides the spool bore 17 into a first spool chamber 17*a* disposed on one side of the housing 1 adjacent to the end plate 9 of the pump unit 3, and a second spool chamber 17*b* located on an opposite side of the housing 1. The drain passage 34 has one end open into the spool bore 17 and an opposite end open into the suction path 15. The first spool chamber 17*a* is in communication with the pressure chamber 11 of the pump unit 3 via a port 35 which is open to the pressure chamber 11 to introduce the fluid within the pressure chamber 11 into the first spool chamber 17*a*. The second spool chamber 17*b* is fluidly connected with the delivery port 22 via a communication passage 37, into which the fluid pressure within the discharge path 16 is induced. The spool 31 has a normal position shown in FIG. 1, in which the spool 31 is urged by the spring 32 to close the drain passage 34 by a land 33 thereof to restrain the fluid communication between the pressure chamber 11 and the drain passage 34. The spool 31 also has an operating position in which the spool 31 is moved rightward as viewed in FIG. 1 against the biasing force of the spring 32 to open the drain passage 34 to allow the fluid communication between the pressure chamber 11 and the drain passage 34.

Mounted to the cover 2 is a pressure switch 41 operative to detect load of the pump unit 3 to control the engine rotation speed, i.e., air-fuel ratio. The pressure switch 41 is disposed within a mount bore formed in the cover 2. The mount bore communicates with the bore 9*b* of the end plate 9 via a radial passage 44 and an axial passage 45 which are formed in the cover 2. The pressure switch 41 includes a fixed contact 41*a* and a moveable contact 41*b*. The moveable contact 41*b* has one end exposed to a passage 42 communicating with the pressure chamber 11. With this arrangement, the pressure switch 41 is actuatable in response to the fluid pressure within the pressure chamber 11.

The housing 1 and the cover 2 are coupled together by means of suitable fastening members, not shown, such as bolts. A seal ring 46 is mounted to the end face of the housing 1 which mates with the cover 2. The seal ring 46 prevents the fluid within the pressure chamber 11 to leak out therefrom. A seal ring 47 is disposed between the cover 2 and the end plate 8 and isolates the pressure chamber 11 from the bore 8*b* of the end plate 8.

An operation of the hydraulic pump will be explained hereinafter.

When the drive shaft 38 is rotated via a suitable member such as pulley, not shown, the rotor 6 connected with the drive shaft 38 is rotatively driven. During rotation of the rotor 6, hydraulic fluid is introduced into the volumetrically increasing pumping chamber 10 of the pump unit 3 via the suction path 15, the suction ports 18*a* and 18*b* and the inlet ports 9*e*, and the fluid in the volumetrically reducing pumping chamber 10 of the pump unit 3 is discharged into the pressure chamber 11. The fluid within the pressure chamber 11 is allowed to enter the first spool chamber 17*a* of the flow control valve 30 and at the same time flow into the discharge path 16, the orifice 21 and the delivery port 22. The fluid fed to the actuator of the power steering system via the delivery port 22 is variably controlled by the flow control valves 23 and 30 cooperating in response to the rotation speed of the drive shaft 38.

Specifically, when the rotor 6 rotates at a low speed, the spool 31 of the flow control valve 30 is placed in the normal position shown in FIG. 1, in which the fluid communication between the pressure chamber 11 and the drain passage 34 is restricted. All the amount of the fluid flowing from the pressure chamber 11 is caused to be delivered to the actuator of the power steering system via the discharge path 16 and the orifice 21 having the maximum opening area. As the rotation speed of the rotor 6 rises up, the amount of the fluid discharged from the pressure chamber 11 increases and enters the first spool chamber 17*a* of the flow control valve 30 to force the spool 31 against the spring 32 while keeping flowing into the discharge path 16 and the orifice 21. The spool 31 is displaced from the normal position to the operating position where the fluid communication between the pressure chamber 11 and the drain passage 34 is established in response to a difference between the fluid pressures upstream and downstream of the orifice 21. The spool 31 thus moves against the biasing force of the spring 32 until the spring 32 is brought into a compressed state having a predetermined length and the drain passage 34 is open. The fluid within the first spool chamber 17*a* is discharged from the drain passage 34 to be fed back to the suction path 15 and a reservoir, not shown. This causes the fluid delivered to the actuator of the power steering system via the discharge path 16 and the orifice 21 to decrease to a predetermined amount. When the rotation speed of the rotor 6 further rises up, the spool 31 is moved to the operating position where the fluid communication between the pressure chamber 11 and the drain passage 34 is maximum. The flow control valve 23 actuates to reduce the maximum opening area of the orifice 21 in response to the flow control valve 30 allowing the maximum fluid communication between the pressure chamber 11 and the drain passage 34. Specifically, the fluid flowing from the pressure chamber 11 into the discharge path 16 is applied to the spool 23*a* of the flow control valve 23 so that the fluid energy causes the spool 23*a* to move against the biasing forces of the springs 24 and 27 to reduce the maximum opening area of the orifice 21. That is, the fluid pressure within the pressure chamber 11 is exerted on the bearing surface 23*c* of the spool 23*a* within the induction passage 16*a* of the discharge path 16 via the outlet port 20. As the fluid energy passing through the discharge path 16 increases, the spool 23*a* is urged to be displaced from the first position shown in FIG. 3 to the second and-third positions shown in FIGS. 4 and 5 against the biasing forces of the respective springs 24 and 27 which act on the spool 23*a*. The opening area of the orifice 21 decreases, allowing the amount of the fluid flowing into the communication passage 16*b* through the orifice 21 to be reduced. The reduced amount of the fluid is fed to the actuator of the power steering system via the delivery port 22.

In this embodiment, the spool 23*a* is connected with the spring 24 and the second spring 27 having a biasing force greater than the biasing force of the spring 24, which are arranged in series, whereby the spool 23*a* of the flow control valve 23 is moveable at two stages in which the biasing forces of the springs 24 and 27 actuate the spool 23*a* to be placed into the corresponding positions. At the first stage, the spool 23*a* is displaced from the position shown in FIG. 3 to the position shown in FIG. 4 against the biasing force of the spring 24 until the bottom wall of the spool 23*a* contacts with the distal end of the cylindrical flange 25*a* of the spring retainer 25. At the second stage subsequent to the first stage, the spool 23*a* is moved from the position shown in FIG. 4 to the position shown in FIG. 5.

With the arrangement explained above, the spring 24 accommodated within the spring chamber defined by the spool 23*a* and the spring retainer 25 is isolated from the fluid passing through the discharge path 16. Namely, the spring 24 is prevented from being struck by the fluid flowing through the induction passage 16*a* into the orifice 21. Further, since the second spring 27 is disposed within the second spring chamber defined by the housing 1 and the spring retainer 25, without being exposed to the fluid passing through the induction passage 16*a*, the second spring 27 is avoided from being stuck by the fluid. The springs 24 and 27 can be restrained from being vibrated by the fluid flow passing through the discharge path 16. Accordingly, the spool 23*a* of the flow control valve 23 can move smoothly and reliably without being influenced by the fluid flow in the discharge path 16. The flow control valve 23 is operated to variably adjust the opening area of the orifice 21, serving for an improved performance of the hydraulic pump in which a stable characteristic of the flow amount of fluid can be obtained.

The hydraulic pump for the power steering system is not limited to the rotary-vane type of the above-described embodiment and may include various other types such as plunger, piston and the like.

What is claimed is:

1. A hydraulic pump, comprising:

a housing;

a pressure chamber within the housing;

a drain passage communicable with the pressure chamber;

a delivery port;

a discharge path fluidly connecting the pressure chamber with the delivery port;

an orifice disposed in the discharge path;

a first flow control valve operative to variably control fluid communication between the pressure chamber and the drain passage in response to a difference between a fluid pressure upstream of the orifice and a fluid pressure downstream of the orifice; and a second flow control valve disposed within the discharge path and operative to variably control an opening area of the orifice in response to energy of fluid passing through the discharge path, said second flow control valve comprising a moveable spool having a bearing surface to which a fluid pressure within the pressure chamber is applied, a spring biasing the spool in such one direction as to increase the opening area of the orifice, and a moveable spring retainer supporting the spring and cooperating with the spool to define a spring chamber accommodating the spring.

2. A hydraulic pump as claimed in claim 1, wherein the second flow control valve includes a second spring biasing the spring retainer against a biasing force of the spring which acts on the spring retainer in a direction opposite to the one direction.

3. A hydraulic pump as claimed in claim 2, wherein the second spring has a biasing force greater than the biasing force of the spring.

4. A hydraulic pump as claimed in claim 3, wherein the spring has a predetermined biasing force to allow a maximum opening area of the orifice.

5. A hydraulic pump as claimed in claim 4, wherein the spool has a first position in which the opening area of the orifice is maximum, a second position in which the opening area of the orifice is medium smaller than the maximum and a third position in which the opening area of the orifice is minimum, said spool being moveable from the first position to the second position against the predetermined biasing force of the spring and from the second position to the third position against the biasing force of the second spring.

6. A hydraulic pump as claimed in claim 5, wherein the second flow control valve actuates to reduce the maximum opening area of the orifice in response to the first flow control valve allowing a maximum fluid communication between the pressure chamber and the drain passage.

7. A hydraulic pump as claimed in claim 1, wherein the discharge path includes a first passage upstream of the orifice and a second passage downstream of the orifice and the first and second passages communicate with each other via the orifice, said second flow control valve being disposed within the first passage.

8. A hydraulic pump as claimed in claim 2, wherein the spool has a spring mount bore forming a part of the spring chamber.

9. A hydraulic pump as claimed in claim 8, wherein the spring retainer has a first spring mount portion retaining one end of the spring, said first spring mount portion having a spring mount bore which is coaxial with the spring mount bore of the spool to form a part of the spring chamber, said first spring mount portion being fitted to the spool.

10. A hydraulic pump as claimed in claim 9, wherein the first spring mount portion of the spring retainer has a guide for allowing a sliding movement of the spool relative to the spring retainer.

11. A hydraulic pump as claimed in claim 10, wherein the spool is formed into a hollow cylindrical shape having a closed end by which an opposite end of the spring is retained.

12. A hydraulic pump as claimed in claim 11, wherein the first spring mount portion of the spring retainer includes a hollow cylindrical-shaped flange including a disk-shaped portion and a circumferential portion joined with the disk-shaped portion to define the spring mount bore, said circumferential portion having a circumferential outer surface defining the guide.

13. A hydraulic pump as claimed in claim 12, wherein the spring retainer has a second spring mount portion axially spaced from the first spring mount portion and retaining one end of the second spring.

14. A hydraulic pump as claimed in claim 13, wherein the second spring mount portion of the spring retainer cooperates with the housing to define a second spring chamber accommodating the second spring.

15. A hydraulic pump as claimed in claim 14, wherein the second spring mount portion of the spring retainer includes a collar integrally formed with the spring retainer, said collar having one axial end face which retains the one end of the second spring and is exposed to the second spring chamber.

16. A hydraulic pump as claimed in claim 13, wherein the spring retainer has a circumferential groove between the first and second spring mount portions which is exposed to the orifice.

17. A hydraulic pump as claimed in claim 14, wherein the housing has a spring mount hole forming a part of the second spring chamber, said spring mount hole having a bottom retaining an opposite end of the second spring.

* * * * *